US006267709B1

(12) United States Patent
Jacques et al.

(10) Patent No.: US 6,267,709 B1
(45) Date of Patent: Jul. 31, 2001

(54) ISOKINETIC RESISTANCE APPARATUS

(75) Inventors: Gary Jacques; Brent Warren King; Ken Wilbur Moore; Daren Paul Tremaine, all of Calgary (CA)

(73) Assignee: Canadian Space Agency, St. Hubert (CA)

( * ) Notice: Subject to any disclaimer, the term of this patent is extended or adjusted under 35 U.S.C. 154(b) by 0 days.

(21) Appl. No.: 09/420,203

(22) Filed: Oct. 18, 1999

Related U.S. Application Data

(60) Provisional application No. 60/104,738, filed on Oct. 19, 1998.

(51) Int. Cl.[7] ..... A63B 21/00

(52) U.S. Cl. ..... 482/8; 482/1; 600/595

(58) Field of Search ..... 482/1–9, 51, 900–902; 600/300, 595; 601/23–26, 33–35

(56) References Cited

U.S. PATENT DOCUMENTS 4,628,910 12/1986 Krukowski ..... 128/25
4,934,694 6/1990 McIntosh ..... 272/129
5,830,160 * 11/1998 Reinkensmeyer ..... 600/595
5,919,115 * 7/1999 Horowitz ..... 482/6
6,155,993 * 12/2000 Scott ..... 600/595

* cited by examiner

*Primary Examiner*—Glenn E. Richman
(74) *Attorney, Agent, or Firm*—Christensen O'Connor Johnson Kindness PLLC

(57) ABSTRACT

An isokinetic resistance apparatus includes a motor having an output shaft and a motor controller adapted to control power to the motor to maintain a first constant rotational speed of the output shaft. The output shaft of the motor rotates a driven shaft in a first rotational direction at a second constant rotational speed. A force receiving member is coupled with the driven shaft by a force transmitting linkage having a unidirectional clutch. A force exerted upon the force receiving member in the first rotational direction is transmitted through the driven shaft and the drive linkage to the output shaft of the motor. The motor controller adjusts power to the motor to compensate for such force and proportionately increase resistance to maintain the first constant rotational speed of the output shaft.

20 Claims, 6 Drawing Sheets

ISOKINETIC RESISTANCE APPARATUS

CROSS REFERENCE TO RELATED APPLICATION

The present application claims the benefit of the filing date of U.S. Provisional Patent Application Ser. No. 60/104,738, filed Oct. 19, 1998.

FIELD OF THE INVENTION

The present invention relates to an isokinetic resistance apparatus for use in exercise, rehabilitation and physical performance testing equipment.

BACKGROUND OF THE INVENTION

With an isometric resistance apparatus, muscles are caused to act against a fixed object. In contrast, with an isokinetic resistance apparatus, muscles are caused to act through a range of movement at a constant rate of speed. Principles of isokinetic resistance are potentially applicable to exercise equipment, rehabilitation equipment and physical performance testing equipment.

SUMMARY OF THE INVENTION

What is required is an isokinetic resistance apparatus.

According to the present invention there is provided an isokinetic resistance apparatus which includes a motor having an output shaft and a motor controller adapted to control power to the motor to maintain a first constant rotational speed of the output shaft. A driven shaft is coupled by a drive linkage to the output shaft of the motor, such the output shaft of the motor imparts movement to rotate the driven shaft in a first rotational direction at a second constant rotational speed. A force receiving member is coupled by a force transmitting linkage with the driven shaft. The force transmitting linkage includes a unidirectional clutch adapted to move freely about the driven shaft in a second rotational direction and engage the driven shaft in the first rotational direction. A force exerted upon the force receiving member tending to move the unidirectional clutch faster than the second constant rotational speed in the first rotational direction is transmitted through the driven shaft and the drive linkage to the output shaft of the motor. The motor controller adjusts power to the motor to compensate for such force and proportionately increase resistance to maintain the first constant rotational speed of the output shaft.

The isokinetic resistance apparatus, as described above, offers a proportional resistance to a person's input while maintaining a set rotational velocity for that motion.

Although beneficial results may be obtained through the use of the apparatus, as described above, even more beneficial results may be obtained when the first constant rotational speed of the output shaft is greater than the second constant rotational speed of the driven shaft, with a speed reduction being effected between the drive linkage. It is preferred the drive linkage utilizes one or more worm gears as there are inefficiencies inherent in a worm gear reducer. It is also preferred that this speed differential be between a range of 20:1 and 60:1. For best results, it is preferred that the range be equal to or greater than 30:1. Due to friction, most worm gears with ratios of 30:1 or higher are self locking so that the low speed driven shaft cannot backdrive the high speed output shaft regardless of the torque applied. This self-locking nature of the gear reducer is used to prevent the torque generated by the subject from increasing the speed of the driven shaft. This allows a very low power motor to resist the torque generated by the test subject.

Although beneficial results may be obtained through the use of the isokinetic resistance apparatus, as described above, in the preferred embodiment resistance can be made bidirectional. This is accomplished by coupling the force receiving member with an input shaft. A force applied to the force receiving member in a first direction rotates the input shaft in a first input direction, a force applied to the force receiving member in a second direction rotates the input shaft in a second input direction. Two force transmitting linkages are provided. A first force transmitting linkage is provided between the input shaft of the force receiving member and the driven shaft. The first force transmitting linkage includes a first unidirectional clutch adapted to move freely about the driven shaft in the second rotational direction and engage the driven shaft in the first rotational direction when force is applied to the input shaft in the first input direction. A second force transmitting linkage is provided between the input shaft of the force receiving member and the driven shaft. The second force transmitting linkage includes a second unidirectional clutch adapted to move freely about the driven shaft in the second rotational direction and engage the driven shaft in the first rotational direction when force is applied to the input shaft in the second input direction. This configuration allows for resistance in both the clockwise and counter clockwise (flexion/extension) directions, without changing rotational direction of the output shaft of the motor.

There are various technologies that can be used for torque transfer linkages without effecting overall performance. There is hereinafter described a force transmitting linkage that includes a bevelled pinion gear secured to the force receiving member that meshes with a bevelled spider gear rotatably mounted to the driven shaft. This form of linkage has been selected as it is viewed as being one of the most direct form of linkages. Alternative linkages can be devised using chains, belts, pulleys, hydraulics or various combinations of the same. The configuration described allows a relatively small motor to absorb substantially higher forces than would otherwise be possible. This allows for a comparatively small and lightweight product.

Although beneficial results may be obtained through the use of the isokinetic resistance apparatus, as described above, even more beneficial results may be obtained when a force monitor is coupled to the force receiving member. The force monitor is adapted to measure force applied to the force receiving member, and thereby provides an objective measurement of performance. There are various technologies that can be used to measure force. The one that will hereinafter be further described is a load cell technology. The load cell technology is preferred because the input shaft of the gearbox can easily be fitted with a load cell to measure torque input to create an inexpensive isokinetic dynamometer.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
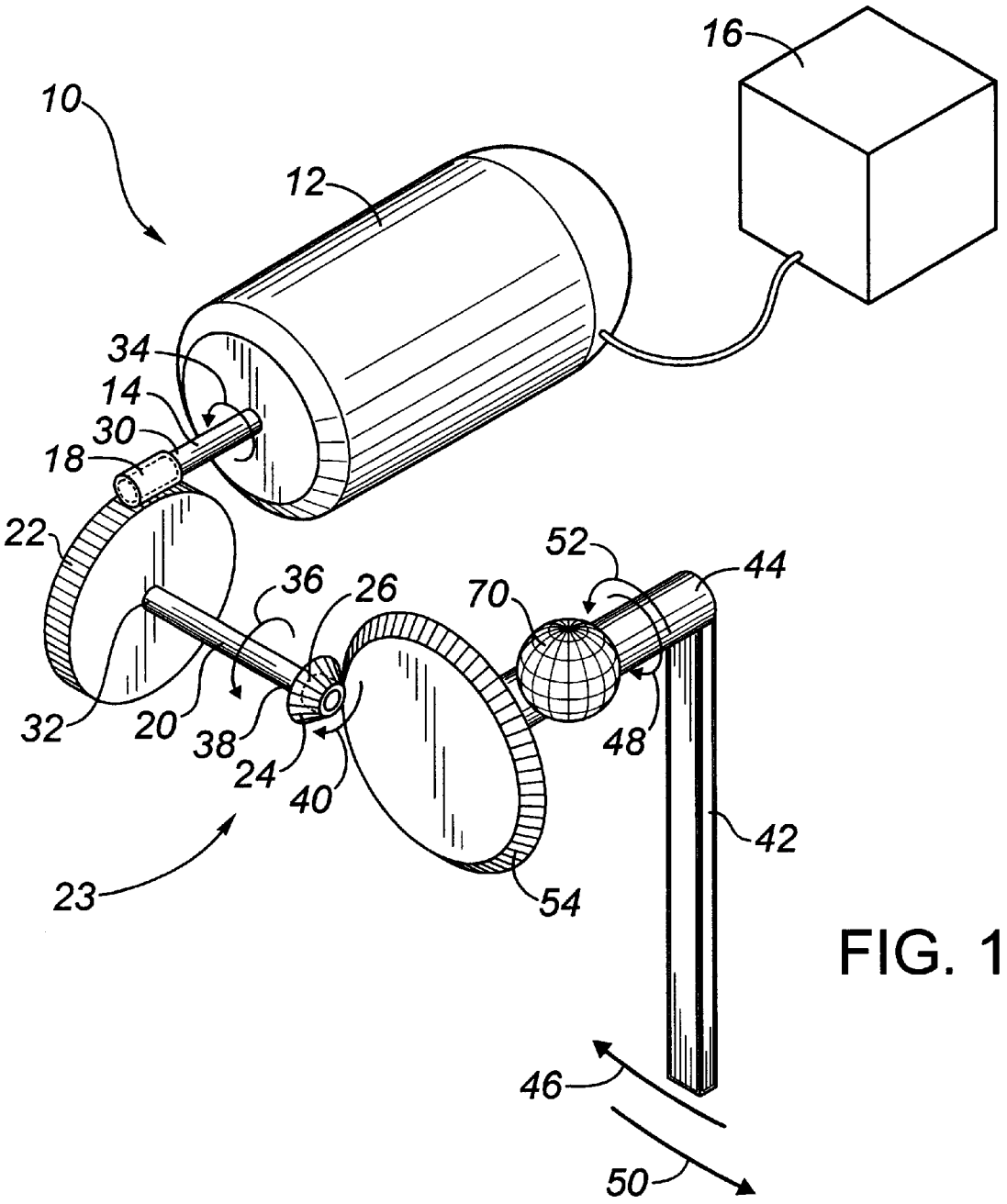
FIG. 1 is a perspective view of a unidirectional isokinetic resistance apparatus constructed in accordance with the teachings of the present invention.

Two preferred embodiments of isokinetic resistance apparatus will now be described with reference to FIGS. 1 through 6. A unidirectional isokinetic resistance apparatus, generally indicated by reference numeral 10, will be described with reference to FIGS. 1 and 6. A bidirectional isokinetic resistance apparatus, generally identified by reference numeral 100, will be described with reference to FIGS. 2 through 6.

Referring to FIG. 1, unidirectional isokinetic resistance apparatus 10, includes a motor 12 having an output shaft 14, and a motor controller 16. Motor controller 16 is adapted to control power to motor 12 to maintain a first constant rotational speed of output shaft 14 in a direction indicated by arrow 34. A drive linkage is provided that includes a worm gear 18 secured coaxially at a remote end 30 of and rotatable with output shaft 14. A driven gear 22 is secured at a first end 32 of and is rotatable with a driven shaft 20. Driven gear 22 meshes with worm gear 18 such that rotation of worm gear 18 with output shaft 14 of motor 12 imparts movement to driven gear 22 to rotate driven shaft 20 in a first rotational direction indicated by arrow 36 at a second constant rotational speed.

The first constant rotational speed of output shaft 14 is greater than the second constant rotational speed of driven shaft 20, with a speed reduction being effected between worm gear 18 and driven gear 22. The ratio of speed reduction between the first constant rotational speed of output shaft 14 and the second constant rotational speed of driven shaft 20 is between 20:1 and 60:1 and is, preferably, greater than 30:1.

A force receiving member, illustrated as a force receiving arm 42 in the illustrated embodiment, is mounted to an input shaft 44. Although the force receiving member is shown as being an arm, there are other forms of force receiving members that could be utilized to input a force through a belts or chain or by placing a hand grip directly onto input shaft 44. A force applied to force receiving arm 42 in a first direction indicated by arrow 46 rotates input shaft 44 in a first input direction indicated by arrow 48. A force applied to force receiving arm 42 in a second direction indicated by arrow 50 rotates input shaft 44 in a second input direction indicated by arrow 52. A force transmitting linkage 23 is located at a second end 38 of driven shaft 20. In the illustrated embodiment linkage 23 includes a bevelled spider gear 24, a bevelled pinion gear 54, and a unidirectional clutch 26 forming part of spider gear 24 and located between spider gear 24 and driven shaft 20. Pinion gear 54 is secured to and is rotatable with input shaft 44. Pinion gear 54 engages spider gear 24 to complete linkage 23. It will be recognized that there are several alternative linkages that can be used in place of spider gear 24 and pinion gear 54, including systems of belts and pulleys or chains looped about cogs. The linkage allows free rotation in one direction and rotation at a speed that cannot exceed the speed of the driven shaft in the other direction, as will hereinafter be further described.

Unidirectional clutch 26 is adapted to move freely about driven shaft 20 in a second rotational direction, indicated by arrow 40, and to engage driven shaft 20 when in first rotational direction 36. Unidirectional clutches are a common industrial device that allow one shaft to rotate freely until it attempts to run faster than the other. The unidirectional clutch is obtainable from several suppliers of unidirectional clutches, including: The Torrington Company, Torrington, Conn.; Dodge, Greenfield, S.C.; and Morse Industrial, Ithaca, N.Y. The unidirectional clutch can readily be fit with bevel gears to form the spider gears illustrated.

The unidirectional clutch included in linkage 23 is adapted to move freely about the driven shaft 20 in second rotational direction 40, but engages driven shaft 20 in first rotational direction 36 when force is applied to input shaft 44 in first input direction 48. A force exerted in first direction 46 upon force receiving arm 42 tending to move unidirectional clutch 26 faster the than second constant rotational speed in first rotational direction 36 is transmitted through driven shaft 20, driven gear 22, and worm gear 18 to output shaft 14 of motor 12. Motor controller 16 adjusts power to motor 12 to compensate for such force and proportionately increases resistance to maintain the first constant rotational speed of output shaft 14. When a force is exerted in second direction 50 upon force receiving arm 42, unidirectional clutch 26 allows spider gear 24 to rotate freely about driven shaft 20.

Figure 2:
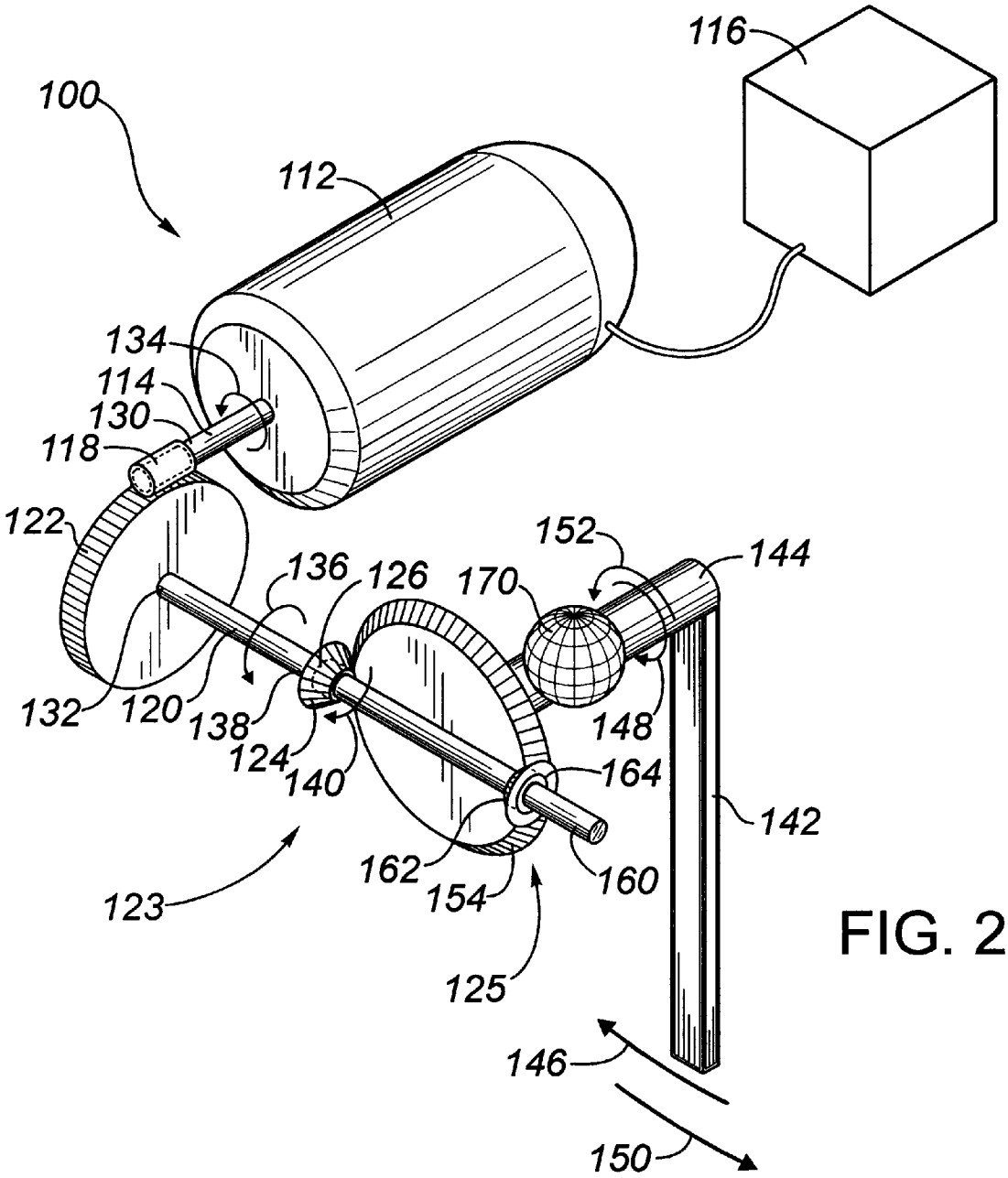
FIG. 2 is a first perspective view of a bidirectional isokinetic resistance apparatus constructed in accordance with the teachings of the present invention.

Referring to FIG. 2, bidirectional isokinetic resistance apparatus 100 is constructed in a similar fashion to unidirectional isokinetic resistance apparatus 10. However, as will hereinafter be further described, to allow for two directional resistance bidirectional isokinetic resistance apparatus 100 employs two unidirectional clutches.

Bidirectional isokinetic resistance apparatus 100 includes a motor 112 having an output shaft 114, and a motor controller 116. Motor controller 116 is adapted to control power to motor 112 to maintain a first constant rotational speed of output shaft 114 in a direction indicated by arrow 134. A drive linkage is provided which includes a worm gear 118 secured coaxially at a remote end 130 and rotatable with output shaft 114. A driven gear 122 is secured at a first end 132 of and is rotatable with a driven shaft 120. Driven gear 122 meshes with worm gear 118 such that rotation of worm gear 118 with output shaft 114 of motor 112 imparts movement to driven gear 122 to rotate driven shaft 120 in a first rotational direction indicated by arrow 136 at a second constant rotational speed.

Figure 3:
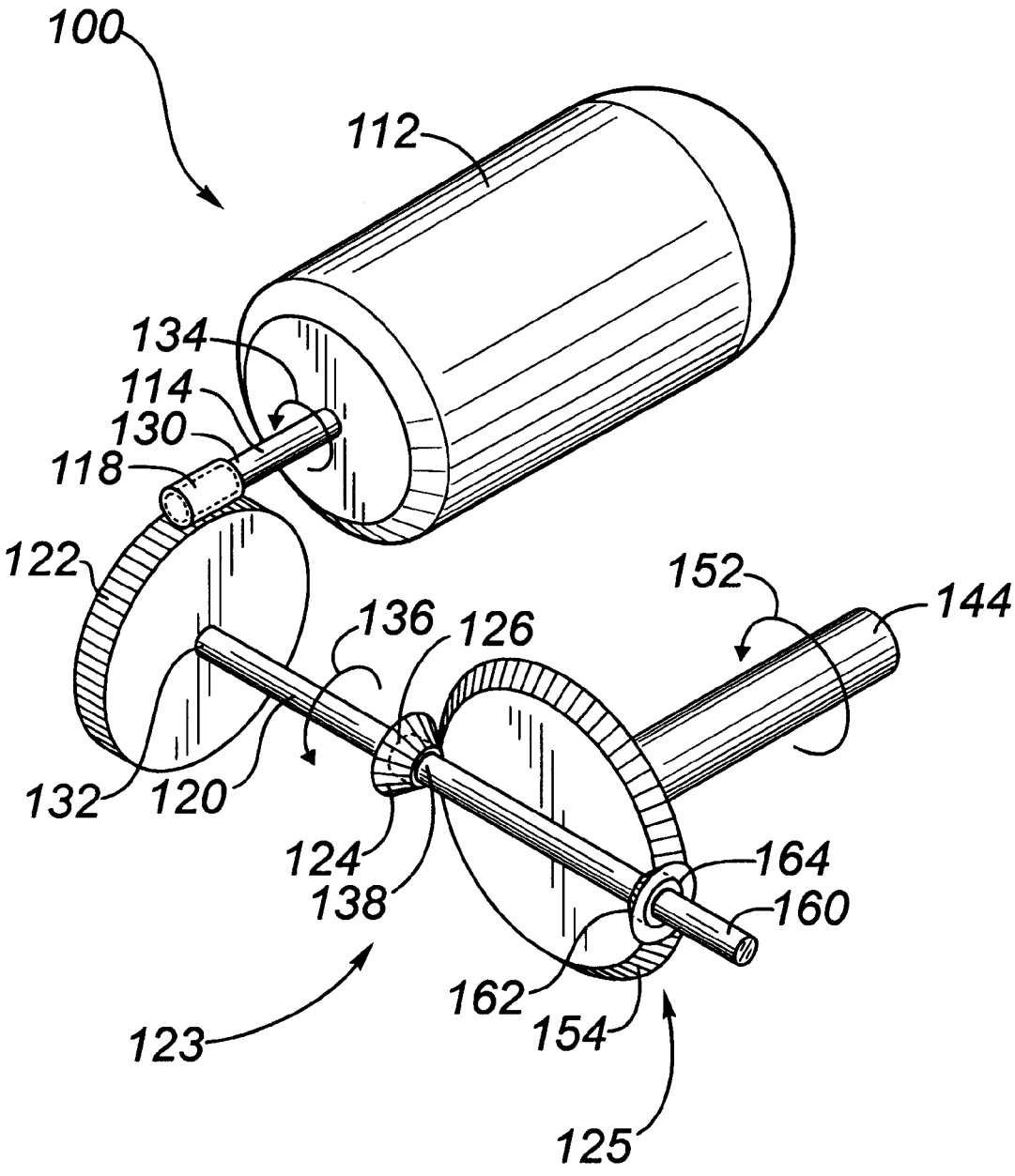
FIG. 3 is a second perspective view of the bidirectional isokinetic resistance apparatus illustrated in FIG. 2, prior to user input.

Referring to FIG. 3, the first constant rotational speed of output shaft 114 is greater than second constant rotational speed of driven shaft 120, with a speed reduction being effected between worm gear 118 and driven gear 122. The ratio of speed reduction between the first constant rotational speed of output shaft 114 and the second constant rotational speed of driven shaft 120 is, preferably, greater than 30:1.

Referring to FIG. 2, a force receiving member, that is a force receiving arm 142 in the illustrated embodiment, is coupled to an input shaft 144. A force applied to force receiving arm 142 in a first direction indicated by arrow 146 rotates input shaft 144 in a first input direction indicated by arrow 148. A force applied to force receiving arm 142 in a second direction indicated by arrow 150 rotates input shaft 144 in a second input direction indicated by arrow 152. A bevelled pinion gear 154 is secured coaxially to the end of input shaft 144 distant from force receiving arm 142.

A first force transmitting linkage 123 between pinion gear 154 and driven shaft 120 is located at a position 138 distanced from first end 132 of driven shaft 120. A second force transmitting linkage 125 between pinion gear 154 and driven shaft 120 is at a second end 160 of driven shaft 120. In the illustrated embodiment first linkage 123 is a first bevelled spider gear 124 and a first unidirectional clutch 126, and second linkage 125 is a second bevelled spider gear 162 and a second unidirectional clutch 164. First unidirectional clutch 126 is situated between first spider gear 124 and driven shaft 120. Second unidirectional clutches 164 is situated between second spider gear 162 and driven shaft 120. It will be recognized that there are several alternative force transmitting linkages that can be used in place of pinion gear 154, first spider gear 124 and second spider gear 162, including systems of belts and pulleys or chains looped about cogs.

Figure 4:
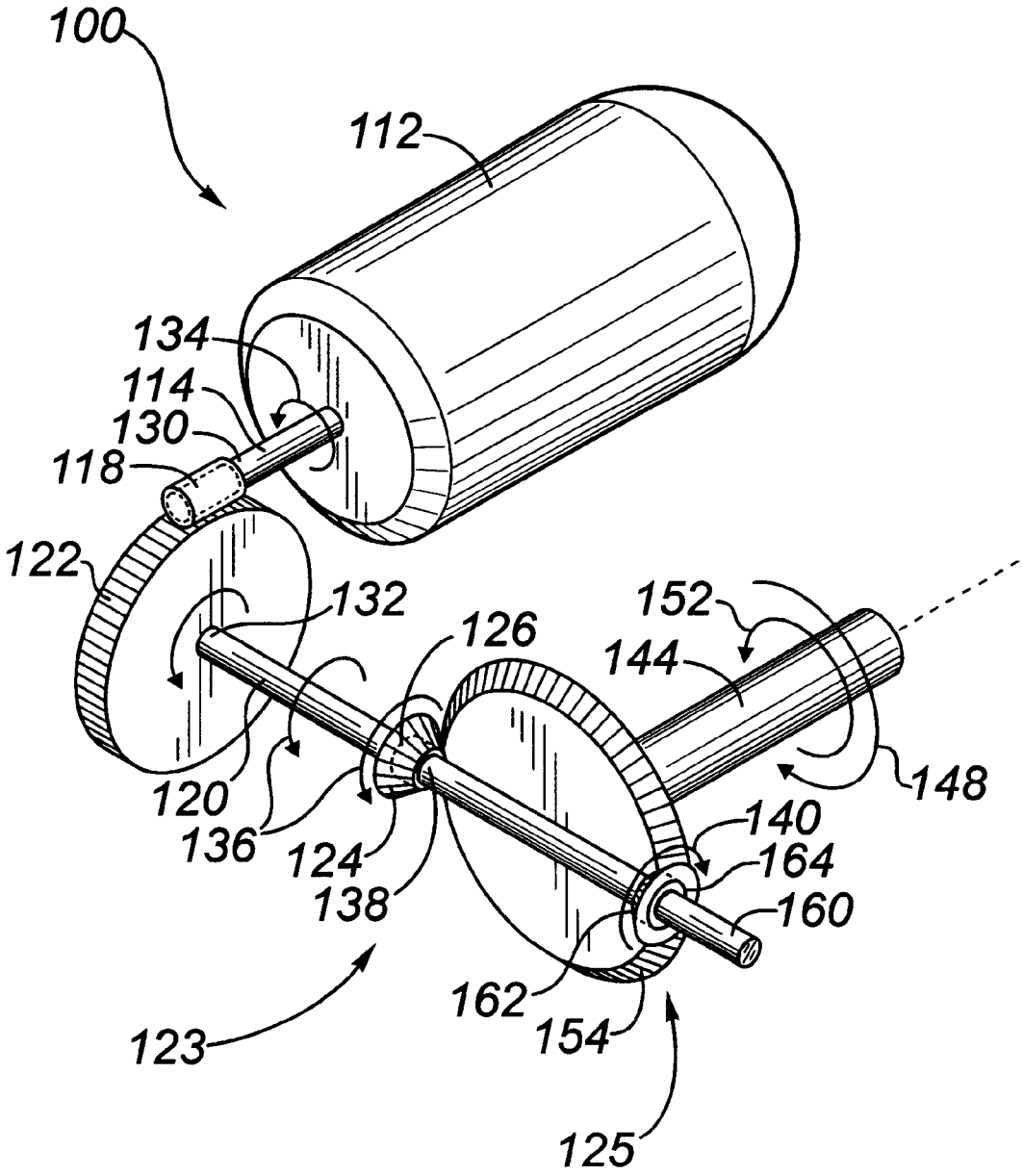
FIG. 4 is a third perspective view of the bidirectional isokinetic resistance apparatus illustrated in FIG. 2, upon user input to the input shaft in a first input direction.
Figure 5:
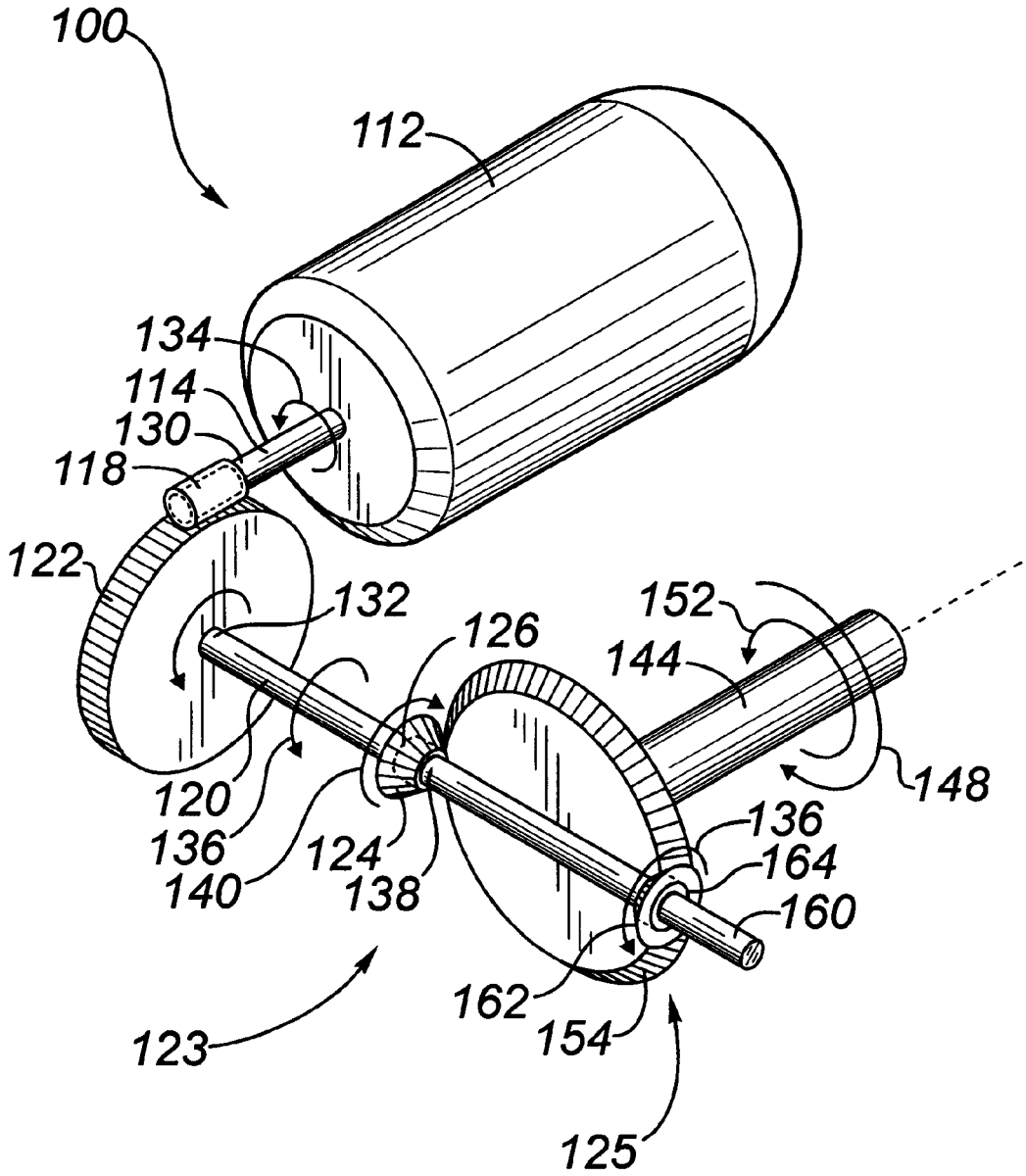
FIG. 5 is a fourth perspective view of the bidirectional isokinetic resistance apparatus illustrated in FIG. 2, upon user input to the input shaft in a second input direction.

Referring to FIG. 2, a force applied force receiving arm 142 in the first direction indicated by arrow 146 rotates input shaft 144 in the first input direction indicated by arrow 148. A force applied to force receiving arm 142 in the second direction indicated by arrow 150 rotates input shaft 144 in the second input direction indicated by arrow 152. Input shaft 144 interacts with bevelled pinion gear 154. Referring to FIGS. 4 and 5, when pinion gear 154 is rotated in first direction 148 or second direction 152, only one of first linkage 123 and second linkage 125 are engaged, as will now be described. First unidirectional clutch 126 is adapted to move freely about driven shaft 120 in a second rotational direction, indicated by arrow 140 as illustrated in FIG. 5, and to engage driven shaft 120 in first rotational direction 136 as illustrated in FIG. 4. Second unidirectional clutch 164 is adapted to move freely about driven shaft 120 in the second rotational direction 140 as illustrated in FIG. 4, and to engage driven shaft 120 in first rotational direction 136 as illustrated in FIG. 5. Referring to FIG. 5, when a force is applied to input shaft 144 in first input direction 148, pinion gear 154 rotates in first direction 148 and only first linkage 123 is engaged. First spider gear 124 engages driven shaft 120 by means of first unidirectional clutch 126, and second spider gear 162 rotates freely. Referring to FIG. 4, when a force is applied to input shaft 144 in second input direction 152, pinion gear 154 rotates in second direction 152 and only second linkage 125 is engaged. First spider gear 124 rotates freely and second spider gear 162 engages driven shaft 120 by means of second unidirectional clutch 164.

Referring to FIG. 2, a force exerted upon force receiving arm 142 in one of first direction 146 and second direction 150 that tends to move one of first unidirectional clutch 126 and second unidirectional clutch 164 faster than second constant rotational speed in first rotational direction 136 is transmitted through driven shaft 120, driven gear 122, and worm gear 118 to output shaft 114 of motor 112. Motor controller 116 adjusts power to motor 112 to compensate for such force and proportionately increase resistance to maintain the first constant rotational speed of output shaft 114.

Referring to FIG. 2, a force monitor 170 is coupled to input shaft 144 of force receiving arm 142. Force monitor 170 is adapted to measure force applied to force receiving member 144. It does this by measuring torque acting upon input shaft 144. In the illustrated embodiment, force monitor 170 is a load cell.

The operation of bidirectional resistance apparatus 100 will now be described with reference to FIGS. 2 through 7. Referring to FIG. 3, motor 112 is run at a set speed dictated by the type of exercise or test that is desired. Motor 112 and output shaft 114 rotate in direction 134, thereby causing driven gear 122 and driven shaft 120 to rotate in first rotational direction 136. When there is no force exerted on input shaft 144, first unidirectional clutch 126 and second unidirectional clutch 164 allow driven shaft 120 to spin freely while first spider gear 124 and second spider gear 162 remain motionless in engagement with motionless pinion gear 154. Referring to FIG. 4, when a force is applied to rotate input shaft 144 in first direction 148, first spider gear 124 is rotated in first rotational direction 136 and second spider gear is rotated in second rotational direction 140. Second unidirectional clutch 164 is not engaged, and second spider gear 162 is not coupled to driven shaft 120 and rotates freely. First unidirectional clutch 126 locks first spider gear 124 rotationally to shaft 120. Forces applied to pinion gear 154 are transmitted through first linkage 123 to driven shaft 120 and so to driven gear 122. The reduction ratio between driven gear 122 and worm gear 118 reduces the force to a reduced value, transmitted through worm gear 118 to output shaft 114 and motor 112, as will be described below with reference to FIG. 6. The force from motor 112 and worm gear 118 is increased using motor controller 116 to balance the reduced force.

Referring to FIG. 5, when a force is applied to rotate input shaft 144 in second direction 152, first spider gear 124 is rotated in second rotational direction 140 and second spider gear is rotated in first rotational direction 136. First unidirectional clutch 126 is not engaged and first spider gear 124 is not coupled to driven shaft 120 and rotates freely. Second unidirectional clutch 164 locks second spider gear 162 rotationally to shaft 120. In the same manner to that described for application of a force to rotate pinion gear 154 in first direction 148, the force applied to pinion gear 154 is transferred through second spider gear 162 to driven shaft 120. The reduced force transmitted through driven gear 122 and worm gear 118 to output shaft 114 is again resisted by increasing power to motor 112 by motor controller 116.

In the three situations, in which pinion gear 154 is not rotating as illustrated in FIG. 3, is rotating in first direction 148 as illustrated in FIG. 4, and is rotating in second direction 152 as illustrated in FIG. 5, motor 112 does not stop or change direction. Motor controller 116 supplies power to motor 112 to maintain the first constant rotational speed in direction 134, increasing or decreasing the power to motor 112, as may be required. The first constant rotational speed and the gear ratio are selected so as to enable motor 112 to maintain a constant rotational speed while having to resist only a fraction of the force applied to by the user to rotate input shaft 144.

Figure 6:
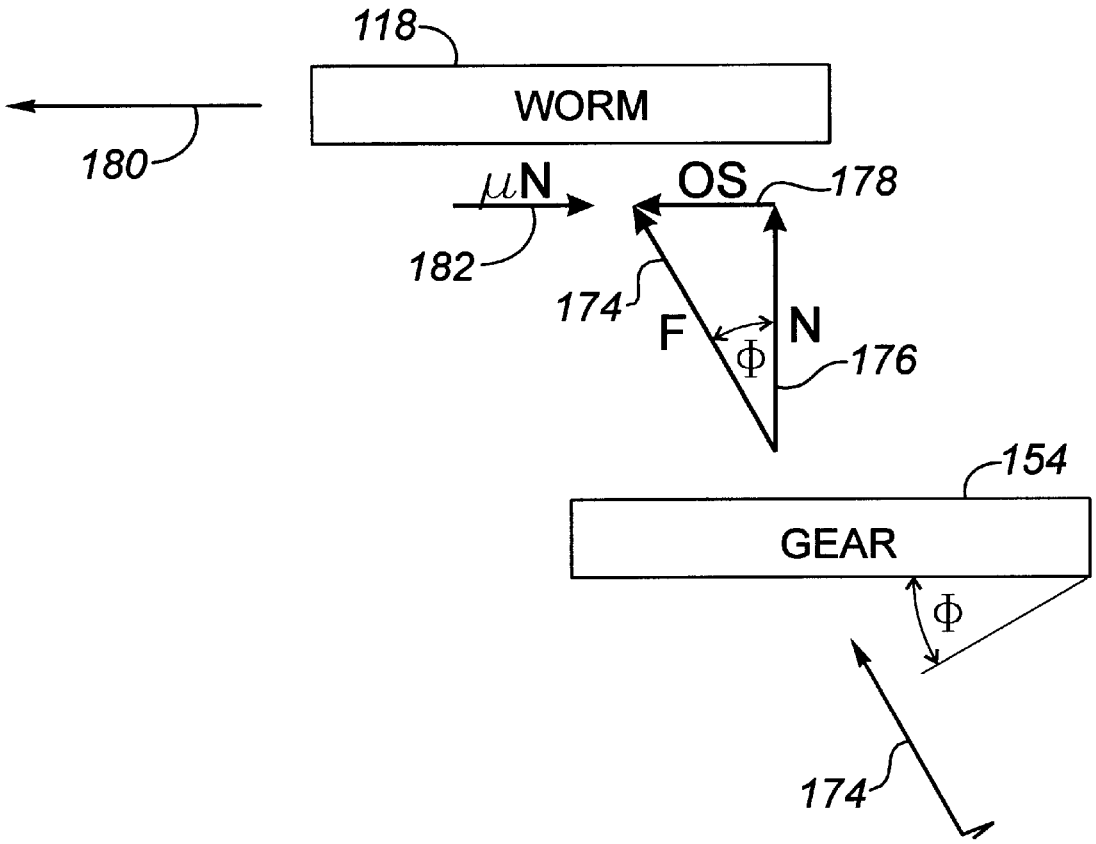
FIG. 6 is a diagram illustrating force vectors acting upon the gears during user input.

The force balance occurring in reduction of force through driven gear 122 and worm gear 118 will now be described with reference to FIG. 6. The force applied to rotate input shaft 144 and pinion gear 154 in one of first direction 148 and second direction 152 produces a force F in the direction indicated by arrows 174. Force F has two components: a first component normal to the worm tooth, N, in a direction shown by arrow 176 at an angle $\Phi$ to direction 174, and a second component, OS, tangential to the teeth of worm gear 118 in a direction shown by arrow 178. The tangential force OS maintains movement of worm gear 118 in the direction it is travelling, indicated by arrow 180. An opposing frictional force $\mu$N in a direction indicated by arrow 182 and opposed to force OS is generated proportional to the normal force. The magnitudes of both forces OS and $\mu$N are dictated by the gear tooth contact angle. The gear ratio and size of the worm gear reducer selected determine the angle of the gear tooth contact $\Phi$. Therefore the size and ratio of worm gear reducer each can be selected so that opposing forces of similar magnitude are generated. This greatly reduces the torque requirement of motor 112 required for apparatus 100.

It will be appreciated by one skilled in the art that alternative embodiments to the embodiment illustrated in FIGS. 2 through 7 can be used without departing from the principles of operation of apparatus 100. The force applied to rotate input shaft 144 can be transmitted to driven shaft 120 using force transmitting linkages other than pinion gear 154 and one of first spider gear 124 or second spider gear 162, including one or more chains and cogs, one or more belts and pulleys, or a hydraulic drive. The illustrated embodiment includes a direct and simple system of linkages.

The preferred embodiment includes a motor controller, bidirectional input through the use of two unidirectional clutches, and the use of worm gears to effect a gear reduction. It will be appreciated by one skilled in the art that several of these preferred features are unique in and of themselves. For example, the ability to resist bidirectional input with a motor that does not stop or change direction, is unique apart from the use of a motor controller or worm gears. Similarly, the ability to provide proportionate resistance through the use of a motor controller that adjusts power inputs to the motor, is unique apart from the ability to receive bidirectional input or worm gears.

The preferred embodiment of the present invention utilizes inefficiencies inherent in worm gears. It will be apparent to one skilled in the art upon reviewing the present invention, that the same result achieved here with a single worm gear configuration can also be achieved by several worm gears working in series or parallel. It will also be apparent to one skilled in the art that the form of worm gear used need not be exactly as illustrated. There are various configurations and derivations of worm gear, such as cone drives, that would yield the same result.

It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. An isokinetic resistance apparatus, comprising:

a motor having an output shaft;

a motor controller adapted to control power to the motor to maintain a first constant rotational speed of the output shaft;

a driven shaft;

a drive linkage coupling the output shaft with the driven shaft, such the output shaft of the motor imparts movement to rotate the driven shaft in a first rotational direction at a second constant rotational speed;

a force receiving member;

a force transmitting linkage between the force receiving member and the driven shaft, the force transmitting linkage including at least one unidirectional clutch adapted to move freely about the driven shaft in a second rotational direction and engage the driven shaft in the first rotational direction;

a force exerted upon the force receiving member tending to move the unidirectional clutch faster than the second constant rotational speed in the first rotational direction is transmitted through the driven shaft and the drive linkage to the output shaft of the motor, the motor controller adjusts power to the motor to compensate for such force and proportionately increase resistance to maintain the first constant rotational speed of the output shaft.

2. The isokinetic resistance apparatus as defined in claim 1, wherein the force transmitting linkage includes a bevelled pinion gear secured to the force receiving member that meshes with a bevelled spider gear rotatably mounted to the driven shaft.

3. The isokinetic resistance apparatus as defined in claim 1, wherein the first constant rotational speed of the output shaft is greater than the second constant rotational speed of the driven shaft a speed reduction being effected through the drive linkage.

4. The isokinetic resistance apparatus as defined in claim 3, wherein the speed reduction is effected by at least one worm gear in the drive linkage.

5. The isokinetic resistance apparatus as defined in claim 3, wherein the ratio between the first constant rotational speed of the output shaft and the second constant rotational speed of the driven shaft is between 20:1 and 60:1.

6. The isokinetic resistance apparatus as defined in claim 5, wherein the ratio between the first constant rotational speed of the output shaft and the second constant rotational speed of the driven shaft is greater than 30:1.

7. The isokinetic resistance apparatus as defined in claim 1, wherein a force monitor is coupled to the force receiving member, the force monitor being adapted to measure force applied to the force receiving member.

8. The isokinetic resistance apparatus as defined in claim 7, wherein the force monitor is a load cell.

9. The isokinetic resistance apparatus as defined in claim 1, wherein the force receiving member is a force receiving arm.

10. The isokinetic resistance apparatus as defined in claim 1, wherein:

the force receiving member is coupled to an input shaft with a force applied to the force receiving member rotating the input shaft in one of a first input direction and a second input direction;

a first force transmitting linkage being provided between the input shaft of the force receiving member and the driven shaft, the first force transmitting linkage including a first unidirectional clutch adapted to move freely about the driven shaft in a second rotational direction and engage the driven shaft in the first rotational direction;

a second force transmitting linkage being provided between the input shaft of the force receiving member and the driven shaft, the second force transmitting linkage including a second unidirectional clutch adapted to move freely about the driven shaft in a second rotational direction and engage the driven shaft in the first rotational direction.

11. An isokinetic resistance apparatus, comprising:

a motor having an output shaft;

a motor controller adapted to control power to the motor to maintain a first constant rotational speed of the output shaft;

at least one worm gear secured to and rotatable with the output shaft;

a driven shaft;

a driven gear secured to and rotatable with the driven shaft, the driven gear meshing with the worm gear such that rotation of the worm gear with the output shaft of the motor imparts movement to the driven gear to rotate the driven shaft in a first rotational direction at a second constant rotational speed;

a force receiving member;

at least one force transmitting linkage between the force receiving member and the driven shaft, the at least one force transmitting linkage including at least one unidirectional clutch adapted to move freely about the driven shaft in a second rotational direction and engage the driven shaft in the first rotational direction;

a force exerted upon the force receiving member tending to move the unidirectional clutch faster than the second constant rotational speed in the first rotational direction is transmitted through the driven shaft, the driven gear, and the worm gear to the output shaft of the motor, the motor controller adjusts power to the motor to compensate for such force and proportionately increase resistance to maintain the first constant rotational speed of the output shaft.

12. An isokinetic resistance apparatus, comprising:

a motor having an output shaft;

a motor controller adapted to control power to the motor to maintain a first constant rotational speed of the output shaft;

at least one worm gear secured to and rotatable with the output shaft;

a driven shaft;

a driven gear secured to and rotatable with the driven shaft, the driven gear meshing with the worm gear such that rotation of the worm gear with the output shaft of the motor imparts movement to the driven gear to rotate the driven shaft in a first rotational direction at a second constant rotational speed, the first constant rotational speed of the output shaft being greater than the second constant rotational speed of the driven shaft with a speed reduction being effected between the worm gear and the driven gear, the ratio of speed reduction between the first constant rotational speed of the output shaft and the second constant rotational speed of the driven shaft being between 20:1 and 60:1;

a force receiving member mounted to an input shaft with a force applied to the force receiving member in a first direction rotating the input shaft in a first input direction and a force applied to the force receiving member in a second direction rotating the input shaft in a second input direction;

a first force transmitting linkage between the input shaft of the force receiving member and the driven shaft, the first force transmitting linkage including a first unidirectional clutch adapted to move freely about the driven shaft in a second rotational direction and engage the driven shaft in the first rotational direction when force is applied to the input shaft in the first input direction;

a second force transmitting linkage between the input shaft of the force receiving member and the driven shaft, the second force transmitting linkage including a second unidirectional clutch adapted to move freely about the driven shaft in a second rotational direction and engage the driven shaft in the first rotational direction when force is applied to the input shaft in the second input direction;

a force exerted upon the force receiving member in one of the first direction and the second direction tending to move one of the first unidirectional clutch and the second unidirectional clutch faster than the second constant rotational speed in the first rotational direction is transmitted through the driven shaft, the driven gear, and the worm gear to the output shaft of the motor, the motor controller adjusts power to the motor to compensate for such force and proportionately increase resistance to maintain the first constant rotational speed of the output shaft.

13. The isokinetic resistance apparatus as defined in claim 12, wherein the first force transmitting linkage includes a bevelled pinion gear secured to and rotatable with the input shaft, the bevelled pinion gear meshing with a first bevelled spider gear rotatably mounted to the driven shaft along with the first unidirectional clutch and the second force transmitting linkage includes a second bevelled spider gear rotatably mounted to the driven shaft along with the second unidirectional clutch, rotation of the input shaft in the first input direction rotating the first bevelled spider gear in the first rotational direction of the driven shaft and the second bevelled spider gear in the second rotational direction of the driven shaft and rotation of the input shaft in the second input direction rotating the first bevelled spider gear in the second rotational direction of the driven shaft and the second bevelled spider gear in the first rotational direction of the driven shaft.

14. The isokinetic resistance apparatus as defined in claim 12, wherein the ratio between the first constant rotational speed of the output shaft and the second constant rotational speed of the driven shaft is greater than 30:1.

15. The isokinetic resistance apparatus as defined in claim 12, wherein a force monitor is coupled to one of the force receiving member and the input shaft, the force monitor being adapted to measure one of force applied to the force receiving member and torque applied to the input shaft to which the force receiving member is attached.

16. The isokinetic resistance apparatus as defined in claim 15, wherein the force monitor is a load cell.

17. An isokinetic resistance apparatus, comprising:

a motor having an output shaft;

a motor controller adapted to control power to the motor to maintain a first constant rotational speed of the output shaft;

a worm gear secured to and rotatable with the output shaft;

a driven shaft;

a driven gear secured to and rotatable with the driven shaft, the driven gear meshing with the worm gear such that rotation of the worm gear with the output shaft of the motor imparts movement to the driven gear to rotate the driven shaft in a first rotational direction at a second constant rotational speed, the first constant rotational speed of the output shaft being greater than the second constant rotational speed of the driven shaft with a speed reduction being effected between the worm gear and the driven gear, the ratio of speed reduction between the first constant rotational speed of the output shaft and the second constant rotational speed of the driven shaft being greater than 30:1;

a force receiving arm mounted to an input shaft with a force applied to the force receiving arm in a first direction rotating the input shaft in a first input direction and a force applied to the force receiving arm in a second direction rotating the input shaft in a second input direction;

a bevelled pinion gear secured to and rotatable with the input shaft;

a first force transmitting linkage between the bevelled pinion gear on the input shaft of the force receiving arm and the driven shaft, the first force transmitting linkage including a first bevelled spider gear and a first unidirectional clutch adapted to move freely about the driven shaft in a second rotational direction and engage the driven shaft in the first rotational direction when force is applied to the input shaft in the first input direction;

a second force transmitting linkage between the bevelled pinion gear on the input shaft of the force receiving arm and the driven shaft, the second force transmitting linkage including a second bevelled spider gear and a second unidirectional clutch adapted to move freely about the driven shaft in a second rotational direction and engage the driven shaft in the first rotational direction when force is applied to the input shaft in the second input direction, the rotation of the second bevelled spider gear being opposed to the first bevelled spider gear with rotation of the input shaft in the first input direction rotating the first bevelled spider gear in the first rotational direction of the driven shaft and the second bevelled spider gear in the second rotational direction of the driven shaft and rotation of the input shaft in the second input direction rotating the first bevelled spider gear in the second rotational direction of the driven shaft and the second bevelled spider gear in the first rotational direction of the driven shaft;

a force exerted upon the force receiving arm in one of the first direction and the second direction tending to move one of the first unidirectional clutch and the second unidirectional clutch faster than the second constant rotational speed in the first rotational direction is transmitted through the driven shaft, the driven gear, and the worm gear to the output shaft of the motor, the motor controller adjusts power to the motor to compensate for such force and proportionately increase resistance to maintain the first constant rotational speed of the output shaft.

18. The isokinetic resistance apparatus as defined in claim 17, wherein a force monitor is coupled to the input shaft, the force monitor being adapted to measure torque applied to the input shaft of the force receiving arm.

19. The isokinetic resistance apparatus as defined in claim 18 wherein the force monitor is a load cell.

20. An isokinetic resistance apparatus, comprising:

a motor having an output shaft;

a driven shaft;

a drive linkage coupling the output shaft with the driven shaft, such the output shaft of the motor imparts movement to rotate the driven shaft in a first rotational direction at a constant rotational speed;

a force receiving member;

a first force transmitting linkage between the force receiving member and the driven shaft, the first force transmitting linkage including a first unidirectional clutch adapted to move freely about the driven shaft in a second rotational direction and engage the driven shaft in the first rotational direction; and a second force transmitting linkage between the force receiving member and the driven shaft, the second force transmitting linkage including a second unidirectional clutch adapted to move freely about the driven shaft in a second rotational direction and engage the driven shaft in the first rotational direction when force is applied to the input shaft in the second input direction.

* * * * *